United States Patent [19]

Imai et al.

[11] Patent Number: 4,702,986

[45] Date of Patent: Oct. 27, 1987

[54] ELECTROPHOTOGRAPHIC METHOD USES TONER OF POLYALKYLENE AND NON-MAGNETIC INORGANIC FINE POWDER

[75] Inventors: Eiichi Imai, Narashino; Kiichiro Sakashita, Kawasaki; Seiichi Takagi, Yokohama; Tsutomo Kukimoto, Kawasaki, all of Japan

[73] Assignee: Canon Kabushiki Kaisha, Tokyo, Japan

[21] Appl. No.: 769,951

[22] Filed: Aug. 27, 1985

[30] Foreign Application Priority Data

| | | | |
|---|---|---|---|
| Aug. 30, 1984 | [JP] | Japan | 59-182284 |
| Aug. 31, 1984 | [JP] | Japan | 59-182169 |
| Apr. 19, 1985 | [JP] | Japan | 60-82665 |
| Apr. 22, 1985 | [JP] | Japan | 60-84613 |

[51] Int. Cl.[4] ..... G03G 13/08

[52] U.S. Cl. ..... 430/120; 430/125; 430/110

[58] Field of Search ..... 430/110, 109

[56] References Cited

U.S. PATENT DOCUMENTS

| | | | |
|---|---|---|---|
| 3,079,342 | 2/1963 | Insalaco | 430/110 |
| 3,964,903 | 6/1976 | Van Besauw | 430/108 |
| 4,099,968 | 7/1978 | Scouten et al. | 430/107 |
| 4,301,228 | 11/1981 | Kori et al. | 430/108 X |

FOREIGN PATENT DOCUMENTS

| | | | |
|---|---|---|---|
| 113054 | 9/1980 | Japan | 430/110 |

*Primary Examiner*—J. David Welsh

*Attorney, Agent, or Firm*—Fitzpatrick, Cella, Harper & Scinto

[57] ABSTRACT

A dry developer for developing electrostatic images comprises (a) toner particles comprising 100 parts by weight of a binder resin and 1–20 parts by weight of polyalkylene having a ratio of weight average molecular weight to number average molecular weight of 2.0–10.0 and Z average molecular weight determined by gel permeation chromatography of 10,000–200,000, and containing 5–60% by weight of a component soluble in n-hexane at boiling point, kinetic friction coefficient of the toner particles being 0.20–0.50, and (b) non-magnetic inorganic fine powders having BET specific surface area according to a nitrogen adsorbing method of 0.5–500 $m^2/g$.

An image forming method comprises using the dry developer to develop electrostatic latent images on a photosensitive member having a surface hardness of 8 g or more, transferring the developed images to a receiving member, and removing the toner particles remaining on the photosensitive member by a cleaning means accompanying abrasion.

22 Claims, 3 Drawing Figures

ELECTROPHOTOGRAPHIC METHOD USES TONER OF POLYALKYLENE AND NON-MAGNETIC INORGANIC FINE POWDER

BACKGROUND OF THE INVENTION

1. Field of the Invention

This invention relates to a dry developer comprising a toner containing a particular polyalkylene and non-magnetic inorganic fine powders and a method for forming images using a particular developer and a photosenstitive member having a hardness of at least a particular value of hardness.

2. Description of the Prior Art

In electrophotographic methods, firstly electrostatic latent images are produced by utilizing the property of photoconductor such as cadmium sulfide, polyvinylcarbazole, selenium, zinc oxide and the like. For example, electric charge is uniformly applied to a photoconductor layer followed by applying imagewise exposure thereto to form electrostatic latent images are developed with toner powders having a polarity opposite to that of the electrostatic latent images, and if desired, transferred to an image receiving sheet, and fixed. In the case of an apparatus having the transferring step, it is usual that the toner not transferred to an image receiving sheet and remaining on the photosensitive member is removed and the photosensitive member is repeatedly used.

As the method for removing the toner remaining on a photosensitive member, there may be usually used blade cleaning method, fur brush cleaning method, magnetic brush cleaning method and the like. These methods are carried out by contacting the cleaning member with the photosensitive member. In these methods, the cleaning member is pressed to the photosensitive member at an appropriate pressure so that the photosensitive member is subjected to scratch and the toner attaches fixedly to the photosensivtive member while the cleaning member is used repeatedly. For example, Japanese Patent Application Laid-open No. 47345/1973 proposes that, for the purpose of avoiding the fixing of toner to a photosensitive member, both a friction decreasing material and an abradant material are added to a toner. Indeed, this proposal is effective to obviate the fixing of toner to a photosensitive member, but there still remains the following problem.

That is, when the friction decreasing material is added in an amount enough for obviating the toner fixing phenomenon, materials of low electric resistance such as paper powders, ozone addition product and the like can not be easily removed which are formed on or attached to the surface of a photosensitive member while the photosensitive member is used repeatedly, and, in particular, latent images formed on the photosensitive member are markedly deteriorated by the materials of low electric resistance under the conditions of high temperature and high humidity. In addition, the amounts of the friction decreasing material and the abradant material are so delicate that a toner of stable characteristics can be obtained with difficulty.

Further, a photosensitive member comprising an organic photoconductor has excellent characteristics, but there are disadvantages that the surface hardness is so low that the surface is subjected to damage and therefore, it is not desirable to clean strongly the surface of the photosensitive member. As a result, it is difficult in the case of the organic photoconductive photosensitive member to remove materials of low electric resistance, as contaminating materials, formed on the surface of the photosensitive member by corona discharging or the like, and paper powders and other materials of low electric resistance attached to the surface of the photosensitive member. In particular, when the above-mentioned materials remain on the photosensitive member at a high temperature and high humidity, the materials absorb moisture disadvantageously resulting in extremely low electric resistance and the formation of irregular latent images.

There have been developed various methods and apparatuses for fixing the toner images to a receiving member such as paper. The most popular method at present is a press-heating method using a heat roller which comprises bringing the toner image surface of a receiving sheet into contact with the surface of a heat roller whose surface is composed of a material having a releasing property with respect to the toner, and passing the toner image surface while contacting it with the heat roller under prcssure. Since the surface of the heat roller and the toner images on the receiving sheet to which the toner images are to be fixed are brought into contact with each other under pressure according to the press-heating method, the heat efficiency upon fusing the toner images to the receiving sheet is very good resulting in a rapid fixation and thereby, this method is markedly effective for high speed eleotrophotographic copying machines.

However, according to the above-mentioned method, the heat roller surface contacts the toner images at a melted state under pressure so that a part of toner images adheres to and transferred to the surface of the heat roller, and then the toner images adhering to the roller surface are transferred again to a receiving sheet, so-called offset phenomenon, and thereby, the receiving sheet is made dirty.

In view of the foregoing, Japanese Patent Application Laid-open Nos. 65231/1974, 27546/1975 and 153944/1980 propose toners for heat roller fixation where polyalkylene is contained in the toner so as to prevent the offset. However, as a result of investigating various toners containing polyalkylene useful for preventing offset in heat roller fixation, it has been found that the above-mentioned problems concerning cleaning are not yet solved satisfactorily.

SUMMARY OF THE INVENTION

An object of the present invention is to provide a toner which hardly injures a photosensitive member.

Another object of the present invention is to provide a toner which does not cause irregularity of latent images even under the conditions of high temperature and high humidity.

A further object of the present invention is to provide a toner having an abrading function and capable of being easily cleaned when remaining on the photosensitive member after transferring.

Still another object of the present invention is to provide a toner which neither attaches to nor fuses to a photosensitive member and which does not form point-like or stripe-like stain in the reproduced images.

A still further object of the present invention is to provide a toner which does not soil a sleeve of a developing apparatus and which can give an image density not lowered even when used repeatedly for a long time.

Still another object of the present invention is to provide a toner which is stable and can be easily cleaned when remaining on the photosensitive member after transferring step.

A still further object of the present invention is to provide a method of forming images comprising a cleaning step capable of sufficiently removing toner particles remaining even after transferring the toner images to an organic photoconductive photosensitive member.

Still another object of the present invention is to provide a method of forming images where attaching and fusing of a toner to an organic photoconductive photosensitive member are prevented and neither point-like nor stripe-like stain is formed in the reproduced images.

According to one aspect of the present invention, there is provided a dry developer for developing electrostatic images comprising (a) toner particles comprising 100 parts by weight of a binder resin and 1–20 parts by weight of polyalkylene having a ratio of weight average molecular weight to number average molecular weight of 2.0–10.0 and Z average molecular weight determined by gel permeation chromatography of 10,000–200,000, and containin 5–60% by weight of a component soluble in n-hexane at boiling point, kinetic friction coefficient of the toner particles being 0.20–0.50, and (b) non-magnetic inorganic fine powders having BET specific surface area according to a nitrogen adsorbing method of 0.5–500 $m^2/g$.

According to another aspect of the present invention, there is provided an image forming method comprising using the dry developer to develop electrostatic latent images on a photosensitive member having a surface hardness of 8 g or more, transferring the developed images to a receiving member, and removing the toner particles remaining on the photosensitive member by a cleaning means accompanying abrasion.

DESCRIPTION OF THE PREFERRED EMBODIMENTS

Figure 1:
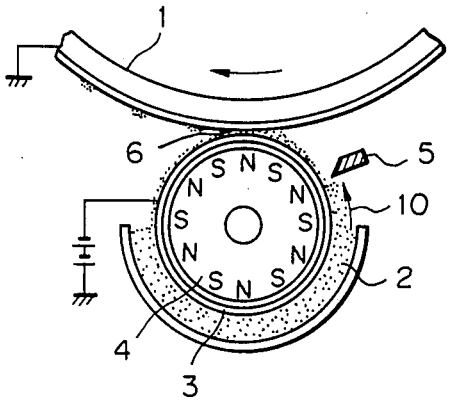
FIG. 1 is a schematic partial cross sectional view of a developing apparatus which may be used for the present invention.

The reasons why the present invention can solve the above-mentioned various problems of prior art toners are as shown below.

The polyalkylene used in the present invention can impart an appropriate degree of kinetic friction coefficient to the toner particles and impart an abrading power to the toner particles, and this abrading power serves to remove materials of low electric resistance and paper powders on a photosensitive member having an appropriate surface hardness without injuring the surface of the photosensitive member.

By combining appropriately a surface hardness of the photosensitive member with a kinetic friction coefficient of toner of the present invention, there can be obtained an appropriate non-adhesivity due to an interaction of the photosensitive member and the toner, and the toner remaining on the surface of the photosensitive member after transferring can be sufficiently removed without injuring the surface of the photosensitive member, and a strong attaching and fusing of the toner to the photosensitive member can be prevented. In addition, filming of the toner and additives on the photosensitive member can be effectively prevented.

The toner having abrasive property of the present invention can prevent soiling of the developing sleeve when contacted with the sleeve and thereby, give a stable image density when a number of copies are produced continuously.

The toner contained in the developer of the present invention has a kinetic friction coefficient of 0.20–0.50, preferably 0.20–0.45 when measured by the following method. The toner having such a specified kinetic friction coefficient can sufficiently exhibit the abrading power imparted to the toner particles themselves without injuring the photosensitive member. As the result, materials of low electric resistance and attached toner on the photosensitive member can be easily removed by the cleaner blade and thereby, irregularity of latent images due to such materials and toner and defective cleaning can be prevented. When the kinetic friction coefficient is too large, the surface of the photosensitive member is liable to be injured and the adhesion of these matters to the photosensitive member is so increased that a sufficient cleaning can not be attained. On the contrary, when the kinetic friction coefficient is too small, the abrading effect is not sufficient.

Where the kinetic friction coefficient is in the above-mentioned range, contact between the toner and the sleeve of developing apparatus is proper and the sleeve is not soiled with toner, and the resulting image density is stable when the toner is repeatedly used many times, in particular, even at a high temperature and a high humidity.

The kinetic friction coefficient is measured as shown below. For example, a flat film of styrene-methyl methacrylate resin of hardness of 20 g corresponding to the surface layer of an organic photoconductive photosensitive member is fixed to a sample stand of a surface property measuing machine, HEIDON 14 TYPE (tradename, manufactured by Shinto Kagaku). To a polyurethane blade (2 mm thick × 10 mm wide × 50 mm long) kept at an angle of 45° is applied a load of 100 g from the upper part, and the sample stand is moved at a speed of 50 mm/min to coat uniformly the flat film with 0.50 g of a toner placed on the flat film.

A vertical load of 100 g is then applied to the resulting toner layer by way of a quatz disc of 15 mm in diameter and the sample stand is moved at a speed of 50 mm/min, and the kinetic friction force is determined to calculate the kinetic friction coefficient.

polyalkylene contained in the developer of the present invention is required to have a ratio of weight average molecular weight to number average molecular weight, Z-average molecular weight calculated from gel permeation chromatography, and content of a component soluble in n-hexane at boiling point in the specified value ranges.

Molecular weight distribution of polyalkylene can be expressed by the value of weight average molecular weight/number average molecular weight (Mw/Mn).

The weight average molecular weight ($\overline{Mw}$) and the number average molecular weight ($\overline{Mn}$) may be determined by various measuring methods. The measuring method used in the present invention is described below.

A number average molecular weight $\overline{Mn}$ is a value obtained by adding products of Mi (molecular weight) and $$Ni/\sum_i Ni$$

(number fraction of molecular weight Mi) from 0 it ∞ as to i where Ni is the number of molecules having a molecular weight Mi, and can be defined by the formula $$\overline{Mn} = \frac{\sum_{i=1}^{\infty} MiNi}{\sum_{i=1}^{\infty} Ni}$$

This is an average as to number of molecules.

On the contrary, weight average molecular weight $\overline{Mw}$ where great importance is attached to contribution of high molecular weight materials to an average molecular weight is defined as follows:

$$\overline{Mw} = \frac{\sum_{i=1}^{\infty} Mi^2Ni}{\sum_{i=1}^{\infty} MiNi}$$

In general, when the objects are high polymers having large molecular weight such as hundred thousands and millions, it does not matter that M (molecular weight of a polymer) has discontinuous values based on a molecular weight of the monomer (Mo), and even if M is regarded as a value varying continuously, there is little error in the mathematical treatment. And the mathematical treatment often becomes simpler. Thus, the rate of number of molecules whose molecular weight is between M and M+dM is designated by n(M)dM. The n(M) is a number distribution function as to molecular weight and satisfies the formula:

$$\int_0^{\infty} n(M)dM = 1,$$

and the number average molecular weight $\overline{Mn}$ is given by the formula:

$$\overline{Mn} = \int_0^{\infty} Mn(M)dM$$

Similarly, the weight average molecular weight $\overline{Mw}$ is designated by the formula:

$$\overline{Mw} = \frac{\int_0^{\infty} M^2n(M)dM}{\int_0^{\infty} Mn(M)dM}$$

A differential weight molecular weight distribution w(M) (=Mn(M)) can be obtained by chromatogram of a gel permeation chromatography (GPC).

Therefore, it is possible to calculate the above-mentioned number average molecular weight and weight average molecular weight simultaneously from chromatogram of GPC.

According to the present invention, in the gel permeation chromatograph, o-dichlorobenzene (0.1% Ionol added) is used as a solvent and 400 μl of a sample solution of 0.1% by weight concentration is introduced at 135° C. at a measuring flow rate of 1.0 ml/min. The molecular weight of the sample is carried out by using a calibration curve produce by using a polystyrene stand sample of a monodisperse system. The column to be used is not limited, but there may be used A-80M (tradename, manufactured by Shodex)

Values of weight average molecular weight and number average molecular weight in the present invention are all those converted as to polystyrene.

The present inventors have found that polyalkylene having the ratio of weight average molecular weight-/number average molecular weight (Mw/Mn) of 2.0–10.0, preferably 5.0–8.0, is desirable. By controlling this ratio (Mw/Mn), offset can be prevented and further, various problems concerning cleaning can be solved. The weight average molecular weight is preferably 3,000–80,000.

Z average molecular weight, $\overline{Mz}$, where great importance is attached to contribution of high molecular weight materials to an average molecular weight is defined as follows:

$$\overline{Mz} = \frac{\sum_{i=1}^{\infty} Mi^3Ni}{\sum_{i=1}^{\infty} Mi^2Ni}$$

where Mi and Ni are as defined above.

Where the Z average molecular weight is expressed by means of a continuous amount, it is shown as follows:

$$\overline{Mz} = \frac{\int_0^{\infty} M^3n(M)dM}{\int_0^{\infty} M^2n(M)dM}$$

The differential weight molecular weight distribution w(M) (=Mn(M)) can be obtained from chromatogram of gel permeation chromatography.

Therefore, the above-mentioned number average molecular weight, weight average molecular weight, and Z average molecular weight can be simultaneously calculated from chromatogram of GPC. The Z average molecular weight is usually 10,000–200,000, preferably 30,000–90,000. By controlling the Z average molecular weight, offset can be prevented, fixing property can be improved and further, various problems concerning cleaning can be obviated.

The polyalkylene to be contained in the toner of the present invention preferably has at least two peaks in the chromatogram of GPC and the main peak is present at the range of molecular weight of 2,000–80,000, preferably 5,000–60,000. At least one of the other peaks is preferably present at the lower molecular weight region than the main peak, more preferably, at the molecular weight region between 1/30 and 1/5 times, particularly preferably 1/20 and 1/10 times the molecular weight of the main peak.

Further, the polyalkylene used in the present invention contains 5–60% by weight, preferably 10–45% by weight, of a component soluble in n-hexane at boiling point, i.e. matter extracted by n-hexane at boiling point.

The matter extracted by n-hexane at boiling point of the polyalkylene used in the present invention means the content of polymer components soluble in n-hexane at boiling point in the polyalkylene, and can be measured as shown below.

A predetermined amount of the polymer (W1 g) is weighed and subjected to extraction by an extracting means such as Soxhlet extracting device to remove the matter soluble in n-hexane at boiling point, in the polymer, and the remaining polymer is dried and weighed (W2 g). The amount of the matter thus extracted is calculated by the formula:

$$\frac{W1 - W2}{W1} \times 100\ (\%)$$

The above-mentioned polyalkylene includes homopolymers such as polyethylene, polypropylene, polybutene, polyhexene and the like, copolymers such as ethylene-propylene copolymer, ethylene-butene copolymer, and the like, terpolymers of hexene with two other monomers such as ethylene, propylene, butene and the like, and polyolefins such as thermally modified products of the above-mentioned polymers. Polypropylene and the thermally modified products thereof are preferable. The amount of the polyalkylene to be added to 100 parts by weight of the resin component is 1–20 parts by weight, preferably 1–10 parts by weight since such addition of polyalkylene can make the unevenness and hardness of the toner surface proper and impart a proper abrasion property to the toner. As the result, the toner of the present invention can prevent the above-mentioned irregularity of latent images and stain in the images due to a matter attaching to the photosensitive member without injuring the photosensitive member.

The developer of the present invention contains non-magnetic inorganic fine powders having BET specific surface area according to a nitrogen adsorbing method of 0.5–500 $m^2/g$, particularly 50–400 $m^2/g$. The amount of the non-magnetic inorganic fine powders is 0.01–10 parts by weight, preferably 0.1–5 parts by weight, per 100 parts by weight of toner.

The addition of the fine powders can decrease the above-mentioned irregularity of latent images. This decrease in the irregularity seems to be due to the large specific surface area of the fine powders which can remove the materials of low electric resistance attached to the photosensitive member by adsorbing or attaching the materials of low electric resistance to the surface of the non-magnetic inorganic fine powders.

As the non-magnetic inorganic fine powders, there may be mentioned powders or particles of alumina, titanium oxide, barium titanate, magnesium titanate, calcium titanate, strontium titanate, zinc oxide, siliceous sand, clay, mica, wollastonite, diatomaceous earth, silicon carbide, various inorganic oxide pigments, chromium oxide, cerium oxide, red iron oxide, antimony trioxide, magnesium oxide, zirconium oxide, barium sulfate, barium carbonate, calcium carbonate, silica fine powders and the like. Among them, metal salts of titanic acid, silicon carbide, cerium oxide and silica fine powders are particularly preferable.

The silica fine powders mentioned here are fine powders having Si-O-Si bond, and may be those produced by a dry process or a wet process. There are various known wet processes for producing silica fine powders.

For example, sodium silicate is decomposed by means of an acid as shown by the following reaction scheme:

$$Na_2O.xSiO_2 + HCl + H_2O \rightarrow SiO_2.nH_2O + NaCl;$$

sodium silicate is decomposed by ammonium salts or alkali salts;

alkaline earth metal silicates are formed from sodium silicate and then decomposed by an acid to produce silica;

solution of sodium silicate is converted to silica by means of an ion exchange resin;

natural silica or silicates are used.

The silica fine powders mentioned here include silicic acid anhydride (silica), aluminum silicate, sodium silicate, potassium silicate, magnesium silicate, zinc silicate and other silicates. The particle size is preferably an average primary particle size of 0.01–2 μm. Silica fine powders containing 85% by weight or more of $SiO_2$ are preferable.

Silica fine powders produced by a dry process is called "dry process silica" or "fumed silica" which may be produced by known techniques. For example, silicon tetrachloride gas is subjected to a thermal decomposition oxidation reaction in oxyhydrogen flame, and the fundamental reaction formula is as shown below:

$$SiCl_4 + 2H_2 + O_2 \rightarrow SiO_2 + 4HCl$$

In this production process, for example, by using a silicon halide compound together with a halide of other metal such as aluminum chloride, titanium chloride and the like, there can be obtained composite fine powders composed of silica and other metal oxide, and such composite fine powders can be used in the present invention.

The particle size is preferably an average primary particle size of 0.001–2μ, and more preferably 0.002–0.2μ of silica fine powders.

As the silica fine powders, there are various commercially available silica, and among them, silica having hydrophobic groups at the surface is preferable, and there are, for example, R-972 (tradename, manufactured by Aerosil Co.) and Tullanox 500 (tradename, manufactured by Tulco Co.).

In addition, there are preferably used silica fine powders treated with silane coupling agent, titanium coupling agent, silicone oil, silicone oil having substituted or unsubstituted amino group at the side chain, or the like.

In particular, where the toner is a positively chargeable toner, positively chargeable silica fine powders are preferable, and where the toner is a negatively chargeable toner, negatively chargeable silica fine powders are preferable.

Absolute value of triboelectric charge of the positively or negatively chargeable silica fine powders is preferably |10| μc/g or more, more preferably |30| μc/g or more. In the following, positively chargeable silica is explained as an example.

Here, positively chargeable silica fine powders may be defined as follows. That is, 2 g of silica fine powders stood overnight at 25° C. at 50–60% RH and 98 g of carrier iron powders having a main particle size of 200–300 mesh and not covered with a resin (for example, EFV 200/300, tradename, produced by Nippon Teppun) are sufficiently mixed under the above-mentioned circumstance in an aluminum pot of 200 cc in volume (shaking up and down with a hand about 50 times), and triboelectric charge of silica fine powders according to an ordinary blow-off method is measured by using a cell made of aluminum having a 400 mesh screen. Silica fine powders having positive triboelectric charge when measured by the above-mentioned method are defined as a positively chargeable silica fine powders.

The positively chargeable silica fine powders may be produced preferably by treating with a coupling agent containing amine or silicone oil.

Such treating agents include aminosilane coupling agents as shown below:

$H_2NCH_2CH_2CH_2Si(OCH_3)_3$
$H_2NCH_2CH_2CH_2Si(OC_2H_5)_3$ $H_2NCH_2CH_2CH_2Si(CH_3)(OCH_3)_2$ $H_2NCH_2CH_2NHCH_2CH_2CH_2Si(CH_3)(OCH_3)_2$ $H_2NCONHCH_2CH_2CH_2Si(OC_2H_5)_3$
$H_2NCH_2CH_2NHCH_2CH_2CH_2Si(OCH_3)_3$
$H_2NCH_2CH_2NHCH_2CH_2NHCH_2CH_2CH_2Si(OCH_3)_3$
$H_5C_2OCOCH_2CH_2NHCH_2CH_2CH_2Si(OCH_3)_3$
$H_5C_2OCOCH_2CH_2NHCH_2CH_2NHCH_2CH_2CH_2Si(OCH_3)_3$ $H_5C_2OCOCH_2CH_2NHCH_2CH_2NHCH_2CH_2NHCH_2CH_2NH(CH_3O)_3SiCH_2CH_2CH_2$ $H_3COCOCH_2CH_2NHCH_2CH_2NHCH_2CH_2CH_2Si(OCH_3)_3$ $(H_5C_2)_2N-CH_2CH_2CH_2Si(OCH_3)_3$

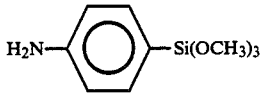

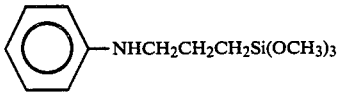

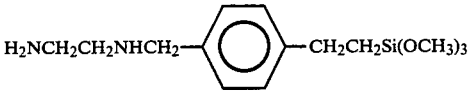

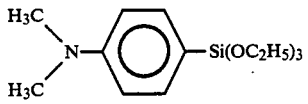

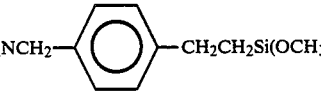

-continued

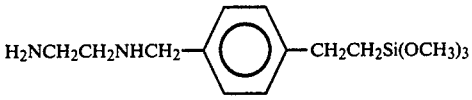

$(HOCH_2CH_2)_2N-CH_2CH_2CH_2Si(OCH_3)_3$ $(H_3CO)_3SiCH_2CH_2CH_2-NHCH_2$
$(H_3CO)_3SiCH_2CH_2CH_2-NHCH_2$ $(H_5C_2O)_3SiCH_2CH_2CH_2)_2NH$
$(H_5C_2O)_3SiCH_2CH_2CH_2$ $H_3CNHCH_2CH_2CH_2Si(OC_2H_5)_3$
$H_2N(CH_2CH_2NH)_2CH_2CH_2CH_2Si(OCH_3)_3$
$H_3C-NHCONHC_3H_6Si(OCH_3)_3$

Further, as the treating agent, there is generally used a modified silicon oil having amino group at the side chain of the following formula:

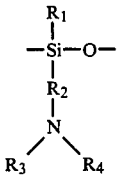

where $R_1$ is hydrogen, alkyl, aryl or alkoxy, $R_2$ is alkylene or phenylene, and $R_3$ and $R_4$ are independently hydrogen, alkyl or aryl. The alkyl, aryl, alkylene and phenylene may have amino group, and they may have substituents such as halogen and the like as far as the substituent does not adversely affect the chargeability.

Examples of the silicone oil are:

| Tradename | Viscosity at 25° C. (cps) | Amino equivalent |
|---|---|---|
| SF8417 (produced by Toray Silicon Co.) | 1200 | 3500 |
| KF393 (produced by Shinetsu Kagaku) | 60 | 360 |
| KF857 (produced by Shinetsu Kagaku) | 70 | 830 |
| KF860 (produced by Shinetsu Kagaku) | 250 | 7600 |
| KF861 (produced by Shinetsu Kagaku) | 3500 | 2000 |
| KF862 (produced by Shinetsu Kagaku) | 750 | 1900 |
| KF864 (produced by Shinetsu Kagaku) | 1700 | 3800 |
| KF865 (produced by Shinetsu Kagaku) | 90 | 4400 |
| KF369 (produced by Shinetsu Kagaku) | 20 | 320 |
| KF383 (produced by Shinetsu Kagaku) | 20 | 320 |
| X-22-3680 (produced by Shinetsu Kagaku) | 90 | 8800 |
| X-22-380D (produced by Shinetsu Kagaku) | 2300 | 3800 |
| X-22-3810B (produced by Shinetsu Kagaku) | 3500 | 3800 |
| X-22-3810B (produced by Shinetsu | 1300 | 1700 |

-continued

| Tradename | Viscosity at 25° C. (cps) | Amino equivalent |
|---|---|---|
| Kagaku) | | |

Amine equivalent in the present invention means an equivalent per one amino group (g/eqiv), that is, a molecular weight divided by the number of amino group per one molecule.

Finely divided silica particles useful in the present invention, positively chargeable or negatively chargeable, are those having a hydrophobicity value of 30–80, which is determined by the methanol titration test. As a hydrophobicizing treatment, there may be utilized known hydrophobicizing methods such as treating finely divided silica particles with an organic silicon compound capable of reacting with or being physically adsorbed by the particles. Preferably, finely divided silica particles are treated with an organic silicon compound simultaneously with or after being treated with previously mentioned treating agents such as silane coupling agents and the like.

Such organic silicon compounds include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, dimethylpolysioxane having 2–12 siloxane units per molecule and one hydroxide group bonded to an Si atom per unit situated at the terminal edge of the chain, or the like. These are used alone or as a mixture of two or more compounds.

Hereupon, the methanol titration test is an experimental test determining the degree of hydrophobicity of finely divided silica particles having a hydrophobicized surface.

The "methanol titration test" prescribed in this specification to evaluate the hydrophobicity of finely divided silica particles after treated may be performed as follows: Finely divided silica particles (0.2 g) to be tested is added to water (50 ml) in an Erlenmeyer flask (250 ml). Methanol is then added dropwise from an burette until the total amount of silica becomes wet. During this step, the solution in the flask is stirred continuously with a magnetic stirrer. The end point can be known from the total amount of silica fine particles being suspended in the liquid. The hydrophobicity is expressed as the percentage of methanol in the mixture of water and methanol at the time of the end point being reached.

Finely divided silica particles shows a preferable effect at a use amount of 0.01–20% based on the weight of a developing agent, and in particular shows a positively or negatively chargeable property with high stability at a use amount of 0.1–3%. A preferable embodiment of the addition of silica fine particles is the state that 0.01–3 percent by weight of treated finely divided silica particles based on the weight of a developing composition adheres to the surface of toner particles.

As the binder resin of the toner used in the present invention, there may be used, alone or mixed, homopolymers of styrene or substitution products thereof such as polystyrene, poly-p-chlorostyrene, polyvinyltoluene and the like; styrene type copolymers such as styrene-p-chlorostyrene copolymer, styrene-propylene copolymer, styrene-vinyltoluene copolymer, styrene vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer; styrene-butyl methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid esters copolymer; polymethyl methacrylate, polybutyl methacrylate, polyvinyl chloride, polyvinyl acetate, polyethylene, polypropylene, polyesters, polyurethanes, polyamides, epoxy resins, polyvinyl butyral, polyacrylic acid resins, rosin, modified rosin, terpene resins, phenolic resins, aliphatic or alicyclic hydrocarbon resins, aromatic petroleum resins, chlorinated paraffin, paraffin wax, carnauba wax and the like.

The toner used in this invention, if necessary, may contain some colorants such as carbon black, copper phthalocyanine, iron black and the like at an amount of 0.1–20 part by weight, preferably 0.5–15 part by weight, based on 100 part by weight of a binder resin. It is usually not necessary to add a colorant to a black toner containing a magnetic substance. A positive or a negative charge-controlling agent known in the art may be used in the present invention.

Also, the toner used in this invention, if necessary, may contain some lubricants, conductivity imparting agents, fixing aids, etc. such as polytetrafluoroethylene powder, polyvinylidene fluoride, metal salts of higher fatty acids, carbon black, conductive tin oxide and the like.

The toner of the present invention is desired to have a bulk specific resistance of greater than $10^{10}$ Ωcm, in particular greater than $10^{12}$ Ωcm. The bulk specific resistance above mentioned is defined as the value calculated from the current value at one minute after the application of an electrid field of 100 V/cm to the toner compacted at a pressure of 100 $Kg/cm^2$.

Further, the toner of the present invention, if desired, may be used as a developer of an electrostatic latent image which is to be used by mixing with carrier powder such as iron powder, glass beads, nickel powder, ferrite powder or the like.

In addition, the toner of the present invention, if necessary, may also contain some magnetic powders. As the magnetic powder, which is a substance to be magnetized by placing in a magnetic field, there may be used the powder of a ferromagnetic metal such as iron, cobalt, nickel and the like, a compound such as magnetite, $\gamma$-$Fe_2O_3$, ferrite and the like, or an alloy thereof. In particular, the magnetic powder is desired to have a BET specific surface area of 2–20 $m^2/g$, in particular 2.5–12 $m^2/g$, and moreover have a Mohs scale of 5–7. The content of the magnetic powder is preferably 10–70 percent by weight based on the weight of the toner.

To the preparation of a toner, there can be applied the process which comprises thoroughly mulling of constituting materials with a hot roll, a kneader, an extruder or the like before machanical pulverization and classification; the process which comprises dispersing materials in the solution of a binder resin before spray-drying; the polymerization-method toner-preparating process which comprises mixing given materials with a monomer expected to constitute a binder resin to afford a emulsified suspension liquid before polymerization; or the like.

The surface hardness of the photosensitive member measured by the following method is desired to be greater than 8 g, preferably 10–100 g. In case of too little hardness, the photosensitive member is readily flawable, which causes the disorder of a latent image in a flawed part at a high humidity or the undesirable transfer of a toner not cleaned. In contrast, in case of too great hardness, the low conductive substance formed on the surface of the photosensitive plate cannot be removed, which causes the disorder of a latent image at a high humidity.

The above-mentioned hardness can be measured as follows.

As an example, the case of measuring that of an OPC photosensitive member is described.

An OPC (organic photoconductive) photosensitive member is fixed on the sample stage of, for example, surface property evaluator (model HEIDON 14, manufactured by Shinto Kagaku), and a vertical load×g is improved on the OPC photosensitive member through a stylus of diamond (cornic-shaped with a cornic angle of 90°; the tip thereof is hemisphere-shaped with a diameter of 0.01 mm) with moving the sample stage at a velocity of 50 mm/min to make a flaw on the surface of the OPC photosensitive member. The width of the scratch is measured, for example, with the microscope attached to the microhardness meter MVK-F (Akashi Seisaku-sho).

The above procedure is repeated with changing the load as, for example, 10 g, 15 g, 20 g, 25 g, 30 g, 35 g and 40 g, and the load making a flow of 50μ wide is calculated as the hardness of the OPC photosensitive member from the relation of linear regression between the width of the flaw and the load. In case that the OPC photosensitive member is a drum, it must be set on the sample stage so that the flow may run in the axial direction.

The developer of the present invention is applicable to various kinds of developing methods. They include, for example, magnetic brush development, cascade development, the method using a conductive magnetic toner described in U.S. Pat. No. 3,909,258, the method using a high resistance magnetic toner described in Japanese Patent Application Laid-open No. 31136/1978, the methods described in Japanese Patent Application Laid-open No. 42141/1979, No. 18656/1980, No. 43027/1979 or the like, fur brush development, powder cloud method, impression development, etc.

In case that the toner of the present invention is used, as a cleaning method, there may be utilized blade cleaning method, fur brush cleaning method, magnetic brush cleaning method or the like, but in the present invention, blade cleaning method is preferable in consideration of the excellent combination of the toner and the photosensitive member. In addition, the step for removing charge, if necessary, may be placed just before the cleaning step.

The developer of the present invention is preferably used for the image forming process which comprises the developing step where an organic photoconductive photosensitive member having a specific surface hardness is contacted with a magnetic toner having a specific coefficient of kinetic friction, and the cleaning step where the remaining toner is removed from said photosensitive member by a cleaning blade and by the abrading effect of said toner.

It is considered that the present invention overcomes the above-described shortcomings by the following reason. That is, the toner particles of the present invention have a moderate grinding tendency, and in the developing step involving contacting and rubbing and the cleaning step using a blade or the like, therefore, remove low electric resistant materials, paper dust or the like without making a flow such as scratch on the organic photoconductive photosensitive member having an appropreate surface hardness owing to its abrading property.

An example of the developing device to be used in the present invention is shown in FIG. 1. The cleaning device is not shown. In FIG. 1, by rotating at least one of sleeve 3 and multipolar magnet 4, magnetic toner 2 is transferred to the direction of arrow 10 and restricted by blade 5 to form a layer of magnetic toner 6. The device is set so that the layer of magnetic toner 6 formed on sleeve 3 may contact and rub photosensitive member 1 at the development portion. A bias voltage may be applied between sleeve 3 and photosensitive member 1. As the transfer method of the present invention, there can be used a known technique such as electrostatic transfer technique bias roll technique, pressure transfer technique, magnetic transfer technique and the like.

As the cleaning method of the present invention, there can be used blade cleaning technique, fur brush cleaning technique, magnetic brush cleaning technique or the like, but blade cleaning technique is preferable in order to actualize the excellent combination with toner and photosensitive member of the present invention. In addition, the step for removing charge, etc. may be placed just before the cleaning step.

Figure 2:
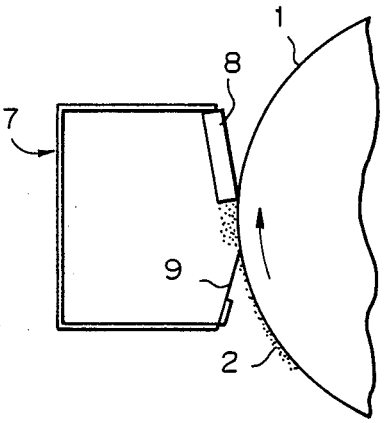
FIG. 2 and FIG. 3 are schematic partial cross sectional views of cleaning apparatuses which may be used for the present invention.
Figure 3:
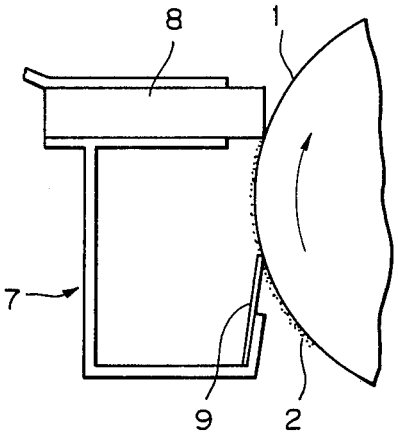

Typical cleaning devices are illustrated in FIGS. 2 and 3.

In the drawings, 1 represents a photosensitive member, and this photosensitive member can be rotated in the direction indicated by an arrow in the drawings. In the operation of the device, an electrostatic latent image is formed on the photosensitive member 1 by a method known in the art, and said latent image is then rendered visible by treatment with a magnetic toner, the developed image subsequently being transferred to a receiving member. A cleaning device 7 is provided to remove the magnetic toner 2 remaining on the photosensitive member 1 after the transference.

The cleaning device shown in FIG. 2 possesses a cleaning member 8 contacting with the surface of a photosensitive member in order to scrape off magnetic toner particles 2 on the photosensitive member 1 and a collecting member 9 for collecting the magnetic toner particles scraped off from the photosensitive member by the cleaning member 8. Generally, the collecting member 9 is arranged in close promixity to the surface of the photosensitive member, and prevents the magnetic toner scraped off by the cleaning member 8 from scattering out of the cleaning device.

The cleaning member 8 is, preferably, an elastic rubber blade with a JIS-A hardness of 60°–80° such as of urethane rubber, and may contact the photosensitive member 1 at a varied angle as shown in FIG. 2 and FIG. 3. The contacting pressure in this case is, preferably, 5–20 g/cm as a line pressure in such a case as FIG. 2, and 30–40 g/cm in such a case as FIG. 3.

The methods of the present invention are concretely described by referring to the following Examples. However, they are not to be construed as being limitative of the invention. Parts in the following examples are by weight.

EXAMPLE 1

The following materials were mixed and meltmulled using a roll mill at 160° C.

(1) 100 parts by weight of styrene-butyl methacrylate-dimethylaminoethyl methacrylate (weight ratio of 7:2.5:0.5) copolymer;

(2) 40 parts by weight of magnetite having BET specific surface area of 5 $m^2/g$ and Mohs scale of 5.5; and (3) 3 parts by weight of polypropylene having the ratio of weight average molecular weight to number average molecular weight of 5.8, having the weight average molecular weight of 15,000, having molecular weight of 14,000 corresponding to a main peak in GPC and molecular weight of 950 corresponding to another peak on the low molecular weight side in GPC, having Z average molecular weight of 60,000, and containing 20 wt. % of boiling-n-hexane-soluble portion.

After cooling, it was crashed using a hammer mill and then milled using a jet mill. Next, it was classified using a wind classifier to obtain black fine perticles as black magnetic toner having volume average particle size of 13 μm. Coefficient of kinetic friction of this toner was 0.28. A developer was prepared by a dry blending of 0.6 part by weight of silica fine particles of BET 140 $m^2/g$ per 100 parts by weight of the thus obtained toner. A lamination type OPC photosensitive member having a charge transport layer comprising methyl methacrylate-styrene (weight ratio of 9:1) copolymer of which Tg measured by DSC is 80° C. or higher was formed on a conductive cylinder to obtain a photosensitive drum. Hardness of this photosensitive member was 21 g.

The photosensitive drum was subjected to a corona discharge of −6 KV at line surface rate of 66 mm/sec to charge it uniformly. Then, an original image was projected to form a latent image. The latent image was developed by setting space between the photosensitive drum surface and the sleeve surface for 0.2 mm in a developing apparatus of sleeve rotation magnet rotation type as shown in FIG. 1 having sleeve diameter of 50 mm, magnetic flux density of the sleeve surface of 700 G, 12 magnetic poles, and space of blade-sleeve of 0.5 mm, by applying bias voltage of −100 V on the sleeve surface and bringing a developer layer, formed on the sleeve, into contact with the photosensitive durm. Next, the toner image was transferred with irradiating the corona of −7 KV from the back side of receiving paper, and then, fixed by a heat roll.

On the other hand, the toner or developer remaining on the drum was cleaned up using a cleaning device as shown in FIG. 2. In this time, the blade of polyurethane rubber of hardness 65° (JIS-A) was brought into contact with the photosensitive drum at pressure of line pressure 15 g/cm.

The running test was carried out for ten thousand times (corresponding to ten thousand pieces of the transfer paper) under usual condition. As a result, poor cleaning did not occur. And the resulting image was good, stable on image density, and free from irregularity of the image. After the running test, the photosensitive members were taken out and observed. As a result, the damage and filming were not found and the toner which has probably remained after the transfer was sufficiently eliminated by the cleaning.

Further. the same tests were carried out under the conditions of 90% RH at 30° C. and 10% RH at 15° C. The results were as good as the above.

EXAMPLE 2

12 parts by weight of silicone oil having amine on the side chain (the viscosity is 70 cps at 25° C. and the equivalent weight of the amine is 830) was sprayed to 100 parts by weight of silica fine particles, which was synthesized by a dry process, with stirring. The resulting solution was treated for 60 minutes while keeping the temperature of 250° C. The triboelectrical charge of the treated silica was +130 μc/g. The Mohs scale of the silica was 6.0.

0.4 parts by weight of the above silicone oil having amine on the side chain was added to 100 parts by weight of black fine particles obtained in Example 1 to obtain a toner. Coefficient of kinetic friction was 0.30.

The copy test was carried out by the same manner as in Example 1. As a result, the clear image was obtained. Further, the running test was carried out for ten thousand times (corresponding to ten thousand pieces of the transfer paper). As a result, poor cleaning did not occur. And the resulting image was good, stable on image density, and free from irregularity of the image. The same tests were carried out under the conditions of 90% RH at 30° C. and 10% RH at 15° C. The results were the same as the above. The photosensitive members after the test were as nearly good as new, had no damage, and were clean state.

EXAMPLE 3

A toner was produced by the same procedure as in Example 2 except that styrene-butyl methacrylate was used in place of styrene-butyl methacrylate-dimethylaminoethyl methacrylate, 3 parts by weight of Nigrosine was added, and further, 70 parts by weight of a magnetic powder having BET specific surface area of 7.8 $m^2/g$ and Mohs scale of 6.5 was added in place of magnetite. Coefficient of kinetic friction of the toner was 0.35.

The copy test was carried out by the same manner as in Example 2. As a result, the clear image was obtained. The running test was carried out for ten thousand times (corresponding to ten thousand pieces of the transfer paper). As a result, the formed image was stable on the density and free from image contamination resulting from materials making the image dirty and poor cleaning.

EXAMPLE 4

This example was carried out by the same procedure as in Example 1 except that styrene-acrylonitrile copolymer, of which Tg is 80° C. or higher, in place of methyl-styrene methacrylate in the photosensitive member in Example 1. The result was good. Hardness of the photosensitive member was 15 g.

EXAMPLE 5

This example was carried out by the same procedure as in Example 1 except that thermally denatured ethylene-propylene copolymer having weight average molecular weight of 48,000 and containing 40 wt. % of boiling-n-hexane-soluble portion was used in place of polypropylene used in Example 1. The result was good. Coefficient of kinetic friction of the toner was 0.20.

EXAMPLE 6

This example was carried out by the same procedure as in Example 2 except that the number of parts by weight of polypropylene which was added in Example 1 was changed to 7 parts by weight. The result was good. Coefficient of kinetic friction of the toner was 0.45.

EXAMPLE 7

This example was carried out by the same procedure as in Example 3 except that a photosensitive member employing methyl polymethacrylate was used that employing methyl-styrene methacrylate in Example 1. The result was good under each of different conditions. Hardness of the photosensitive member was 38 g.

EXAMPLE 8

This example was carried out by the same procedure as in Example 1 except that polypropylene having weight average molecular weight of 7,200 and containing 38 wt. % of boiling-n-hexane-soluble portion was used in place of polypropylene used in Example 1. The result was good. Coefficient of kinatic friction of the toner was 0.21.

COMPARATIVE EXAMPLE 1

A toner was prepared by the same procedure as in Example 1 without adding polypropylene used in Example 1. Coefficient of kinetic friction of the toner was 0.12.

The running test was carried out under the condition of high temperature and high humidity. As a result, remarkable irregularity of the image occurred resulting from poor cleaning.

COMPARATIVE EXAMPLE 2

This example was carried out by the same procedure as in Example 2 except for using polyethylene having weight average molecular weight of 2,800 and containing 62 wt. % of boiling-n-hexane-soluble portion.

The running test was carried out under the condition of high temperature and high humidity. As a result, remarkable irregularity of the image occurred resulting from poor cleaning. Coefficient of kinetic friction of the toner was 0.14.

COMPARATIVE EXAMPLE 3

This example was carried out by the same procedure as in Example 2 except for using 8 parts by weight of polypropylene having weight average molecular weight of 45,000 and containing 3.0 wt. % of boiling-n-hexane-soluble portion.

Coefficient of kinetic friction of the toner was 0.67.

As the result of the running test under the conditions high temperature and high humidity, much damage were formed on the photosensitive member. Thereby, irregularity of the image occurred.

EXAMPLE 9

The formulation of the toner in Example 1 was altered. That is, a black toner was prepared by using styrene-butyl methacrylate copolymer in place of styrene-butyl methacrylate-dimethylaminoethyl-methacrylate copolymer, adding 3 parts by weight of Nigrosin, adding 5 parts by weight of a carbon black in place of magnetite, and adding 2 parts by weight of polypropylene having weight average molecular weight of 29,000, having the ratio of weight average molecular weight to number average molecular weight of 3.6, having molecular weight of 28,000 corresponidng to a main peak in GPC and molecular weight of 550 corresponding to another peak on the low molecular weight side in GPC, having Z average molecular weight of 79,000, and containing 12 wt. % of boiling-n-hexane-soluble portion. Coefficient of kinetic friction of the toner measured was 0.39. 10 parts by weight of this toner and 90 parts by weight of iron powder (trade name: ETV 250-400, mfd. by Nippon teppun) were mixed to prepare a developer which was applied to a copying machine, on the market, having a two-component magnetic brush developing system. In the cleaning apparatus, a contacting angle of the blade was altered and a line pressure of 35 g/cm was set up. The copy was performed similarly to Example 1 except the above. As a result, the clear image was formed. Further, the running test was carried out for ten thousand times (corresponding to ten thousand pieces of the transfer paper). Thus resulting image was good, stable on image density, and free from irregularity of the image. The same tests were carried out under the conditions of 90% RH at 30° C. and 10% RH at 15° C. The results were the same as the above. The drums after the test were as nearly good as new and clean state without stain.

EXAMPLE 10

This example was carried out by the same procedure as in Example 1 except that thermally denatured ethylene-propylene copolymer having $\overline{Mw}$ of 48,000 and $\overline{Mw}/\overline{Mn}$ of 8.0 was used in place of polypropylene in Example 1. The result was good. Coefficient of kinetic friction of the toner was 0.20.

COMPARATIVE EXAMPLE 4

This example was carried out by the same procedure as in Example 2 except that polyethylene having $\overline{Mw}$ of 2,800 and $\overline{Mw}/\overline{Mn}$ of 1.9 was used. The running test was carried out under the condition of high temperature and high humidity. As a result, remarkable irregularity of the image occurred. Coefficient of kinetic friction of the toner was 0.14.

COMPARATIVE EXAMPLE 5

This example was carried out by the same procedure as in Example 2 except that 8 parts by weight of polypropylene having $\overline{Mw}$ of 93,000 and $\overline{Mw}/\overline{Mn}$ of 12.5 was used. Coefficient of kinetic friction of the toner was 0.67.

The running test was carried out under the condition of high temperature and high humidity. As a result, much damage were formed on the photosensitive member, and thereby, irregularity of the image occurred.

EXAMPLE 11

This example was carried out by the same procedure as in Example 1 except for using thermally denatured ethylene-propylene copolymer having molecular weight of 50,000 corresponding to a main peak in GPC and molecular weight of 600 corresponding to another peak on the low molecular weight side in GPC, and having Z average molecular weight of 98,000, in place of polypropylene used in Example 1. The result was good. Coefficient of kinetic friction of the toner was 0.20.

EXAMPLE 12

This example was carried out by the same procedure as in Example 1 except for using polypropylene having molecular weight of 7,000 corresponding to a main peak in GPC and molecular weight of 550 corresponding to another peak on the low molecular weight side in GPC, and having Z average molecular weight of 16,000, in place of polypropylene used in Example 1. The result was good. Coefficient of kinetic friction of the toner was 0.21.

COMPARATIVE EXAMPLE 6

This example was carried out by the same procedure as in Example 2 except for using polyethylene having molecular weight of 2,500 corresponding to a main peak in GPC and having Z average molecular weight of 8,500 in place of polypropylene used in Example 2. As the result of the running test under the condition of high temperature and high humidity, remarkable irregularity of the image occurred. Coefficient of kinetic friction of the toner was 0.14.

COMPARATIVE EXAMPLE 7

This example was carried out by the same procedure as in Example 2 except for using 8 parts by weight of polypropylene having molecular weight of 45,000 corresponding to a main peak in GPC and having Z average molecular weight of 280,000 in place of polypropylene used in Example 2. Coefficient of kinetic friction of the toner was 0.67. As the result of the running test under the condition of high temperature and high humidity, much damage were formed on the photosensitive member, and thereby, irregularity of the image occurred.

What is claimed is:

1. An image forming method which comprises:

forming electrostatic latent images on a photosensitive member having a surface hardness of 8 g or more;

developing the electrostatic latent images with a dry developer comprising (a) toner particles comprising 100 parts by weight of a binder resin and 1–20 parts by weight of polyalkylene having a ratio of weignt average molecular weight to number average molecular weight of 5–8 and Z average molecular weight determined by gel permeation chromatography of 10,000–200,000, and containing 5–60% by weight of a component soluble in n-hexane at boiling point, the toner particles having a kinetic friction coefficient of 0.20–0.50, and (b) non-magnetic inorganic fine powder having BET specific surface area according to a nitrogen adsorbing method of 0.5–500 $m^2/g$;

transferring the developed visible images to a receiving member; and removing the toner particles remaining on the photosensitive member by a cleaning means accompanying abrasion.

2. An image forming method according to claim 1 in which the surface hardness of the photosensitive member is 10–100 g.

3. An image forming method according to claim 1 in which the polyalkylene has a weight average molecular weight of 3,000–80,000.

4. An image forming method according to claim 3 in which the chromatograph by gel permeation chromatography of the polyalkylene has at least two peaks and the molecular weight corresponding to the main peak is 2,000–80,000, at least one of the other peaks being present at the lower molecular weight region than the main peak.

5. An image forming method according to claim 1 in which the non-magnetic inorganic fine powder is composed of metal salts of titanic acid, cerium oxide, silica or silicon carbide.

6. An image forming method according to claim 5 in which the non-magnetic inorganic fine powder is silica having BET specific surface area according to a nitrogen adsorbing method of 50–400 $m^2/g$.

7. An image forming method according to claim 6 in which the silica is treated with a silicone oil having a substituted or unsubstituted amino group at a side chain or a silane coupling agent having a substituted or unsubstituted amino group.

8. An image forming method according to claim 7 in which the silica has a hydrophobicity determined by a methanol titration test of 30–80.

9. An image forming method according to claim 1 in which the toner particles contain 10–70% by weight of magnetic powders.

10. An image forming method according to claim 9 in which the magnetic particles have a BET specific surface area according to a nitrogen adsorbing method of 2–20 $m^2/g$ and Mohs hardness of 5–7.

11. An image forming method according to claim 2 in which the photosensitive member is an organic photoconductive photosensitive member.

12. An image forming method according to claim 1 in which the photosensitive member is an organic photoconductive photosensitive member, and the developer comprises magnetic toner particles.

13. An image forming method according to claim 12 in which the electrostatic latent images are developed by bringing the developer into contact with the photosensitive member.

14. An image forming method according to claim 1 in which the cleaning means is a cleaning blade composed of urethane rubber.

15. An image forming method according to claim 1, in which the silica is added to the developer in an amount of 0.1–3% by weight based on the toner particles.

16. An image forming method according to claim 1, in which the polyalkylene is polypropylene or a thermally modified product thereof and the non-magnetic inorganic fine powder is silica particles having a hydrophobicity of 30–80 as determined by a methanol titration test.

17. An image forming method according to claim 1, in which the toner is a positive chargeable toner containing polypropylene and the non-magnetic inorganic fine powder is a positively chargeable silica having a hydrophobicity of 30–80 as determined by a methanol titration test.

18. An image forming method according to claim 17, in which the positive chargeable silica is prepared by treating a silica with either a silicone oil having a substituted or unsubstituted side chain amino group or a silane coupling agent having a substituted or unsubstituted amino group.

19. An image forming method according to claim 1, in which the polyalkylene comprises polypropylene.

20. An image forming method according to claim 19, in which the polypropylene is contained in the toner particles in an amount of from 1 to 10 parts by weight.

21. An image forming method according to claim 1, in which the polyalkylene comprises an ethylene-propylene copolymer.

22. An image forming method according to claim 21, in which the ethylene-propylene copolymer is contained in the toner particles in an amount of from 1 to 10 parts by weight.

* * * * *

UNITED STATES PATENT AND TRADEMARK OFFICE

CERTIFICATE OF CORRECTION

PATENT NO. : 4,702,986

DATED : October 27, 1987

INVENTOR(S) : EIICHI IMAI, ET AL.

It is certified that error appears in the above-identified patent and that said Letters Patent is hereby corrected as shown below:

On the Title Page

AT [75] IN THE INVENTORS

"Tsutomo Kukimoto," should read --Tsutomu Kukimoto,--.

COLUMN 19

Line 49, "weignt" should read --weight--.

COLUMN 20

Line 60, "positive" should read --positively--.
Line 66, "positive" should read --positively--.

Signed and Sealed this

Third Day of May, 1988

*Attest:*

*Attesting Officer*

DONALD J. QUIGG

*Commissioner of Patents and Trademarks*